United States Patent [19]

Gurley

[11] 4,077,345

[45] Mar. 7, 1978

[54] SAILBOAT CONSTRUCTION

[76] Inventor: Grey M. Gurley, 900 Tioga Dr., Apt 204, Ventura, Calif. 93001

[21] Appl. No.: 773,401

[22] Filed: Mar. 2, 1977

[51] Int. Cl.[2] ..... B63H 9/08

[52] U.S. Cl. ..... 114/39; 114/102

[58] Field of Search ..... 114/39, 102, 103, 90, 114/96, 98

[56] References Cited

U.S. PATENT DOCUMENTS

| | | | |
|---|---|---|---|
| 3,505,967 | 4/1970 | Peterson | 114/90 |
| 3,656,444 | 4/1972 | Kratz | 114/102 |
| 3,889,620 | 6/1975 | Dorland | 114/39 |

*Primary Examiner*—Trygve M. Blix
*Assistant Examiner*—Jesus D. Sotelo
*Attorney, Agent, or Firm*—Jack C. Munro

[57] ABSTRACT

A sailboat which includes a hull and a sail assembly with the sail assembly being rotatable with respect to the hull. The rotational axis of the sail passes through the center of the sail so that equal wind force is applied across the sail with respect to the access of rotation of the sail. Rotation retarding structure in the form of a detent or in the form of a frictional drag operates between the sail assembly and the hull. The sail is mounted between a pair of elongated rods with each of the rods being removably secured to a mounting member which is rotatably mounted upon the hull.

13 Claims, 18 Drawing Figures

SAILBOAT CONSTRUCTION

BACKGROUND OF THE INVENTION

The field of this invention relates to sailboats and more particularly to a rotatable symmetrical sail and to an assembly for supporting such and further to a collapsible sail assembly to facilitate storage.

In the past, there have been a great number of different shapes and configurations for sails of sailboats with the most widely known and widely used sail configuration being that of a right triangle. With such a right triangle shaped sail, a vertical mast is attached to the hull of the boat and a horizontal boom extends outwardly at a right angle from the mast. The sail is attached between the mast and the boom with the sail assembly being rotatable about the longitudinal center axis of the mast. The boom, upon rotation, describes a horizontally oriented circle having its center at the axis of the mast.

Although many other types of sail configurations have been advanced, because of the simplicity of construction and operation of the right triangular shaped sail, most sail configurations are variations of this type of sail and enjoy its advantages and disadvantages. One of the particular disadvantages of the right triangular type of sail is, when the wind moves from one side of the boom to the other, it may catch the sail and whip the boom from one side of the boat to the other. This condition, known as "jibing" is particularly dangerous when it occurs unexpectedly.

Another disadvantage of the right triangular type of sail design is that when sailing a cross wind, the boat typically swings over to one side with the mast being at an angle of 45° or less from horizontal. Thus, special hull design configurations must be made to reduce the water drag against the hull surface and particularly operating percautions must be taken to prevent the boat from capsizing completely.

Additionally, triangular sail configurations restrict the maneuverability of the boat. There are particular angles or directions with respect to the wind in which the boat cannot be made to move at all. This condition, for example, is when the bow of the boat is oriented directly into the wind.

Finally, the operation of most right triangular shaped sails require some expertise and also considerable physical strength to operate the cables and rigging used in conjunction therewith. Thus, ordinarily a certain degree of experience is necessary to perform even the simplest sailing operations using commonly employed sails and rigging. In accordance with the broad principles of this invention, the sailboat includes a symmetrical sail and assembly for rotatably mounting the sail assembly upon the hull of the boat. The sail assembly includes a pair of elongated members (booms) for carrying the sail therebetween. The rotational axis of the sail assembly passes through the mid point of the sail so that in essence in comparison to the rotational axis of the sail assembly, the sail is divided into equal parts. The sail booms are attached to a mounting bracket which is directly rotatably mounted upon the hull. Each boom is releasably secured by means to the mounting bracket and is capable of pivotal movement in respect thereto toward the other boom. This permits the sail to be collapsed when not in use.

In any position of the sail, the center of the wind effort upon the sail remains in a substantially constant location with respect to the sailboat.

The primary objective of this invention is to construct a few parts a symmetrical sail for a wind propelled vehicle.

It is a further object of this invention to construct a sail assembly with its axis of symmetry intersecting the longitudinal axis of the wind propelled vehicle.

It is a further object of this invention to provide a jibe proof sail.

It is another further object of this invention to provide a sail having a center of wind pressurwe which remains in a constant position regardless of the attitude of the sail.

It is another object of this invention to provide a wind propelled vehicle which can be readily and easily maneuvered by a relatively unskilled operator.

DETAILED DESCRIPTION OF THE SHOWN EMBODIMENT

Figure 1:
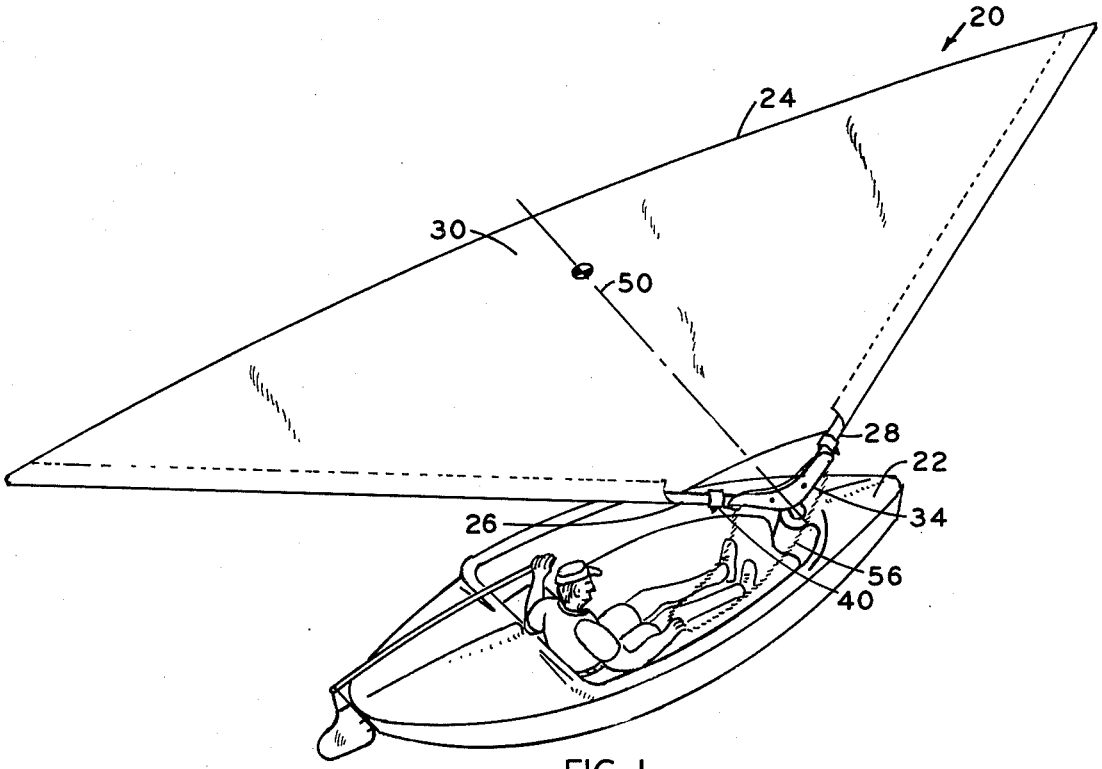
FIG. 1 is an isometric view of a sailboat constructed in accordance with this invention.
Figure 2:
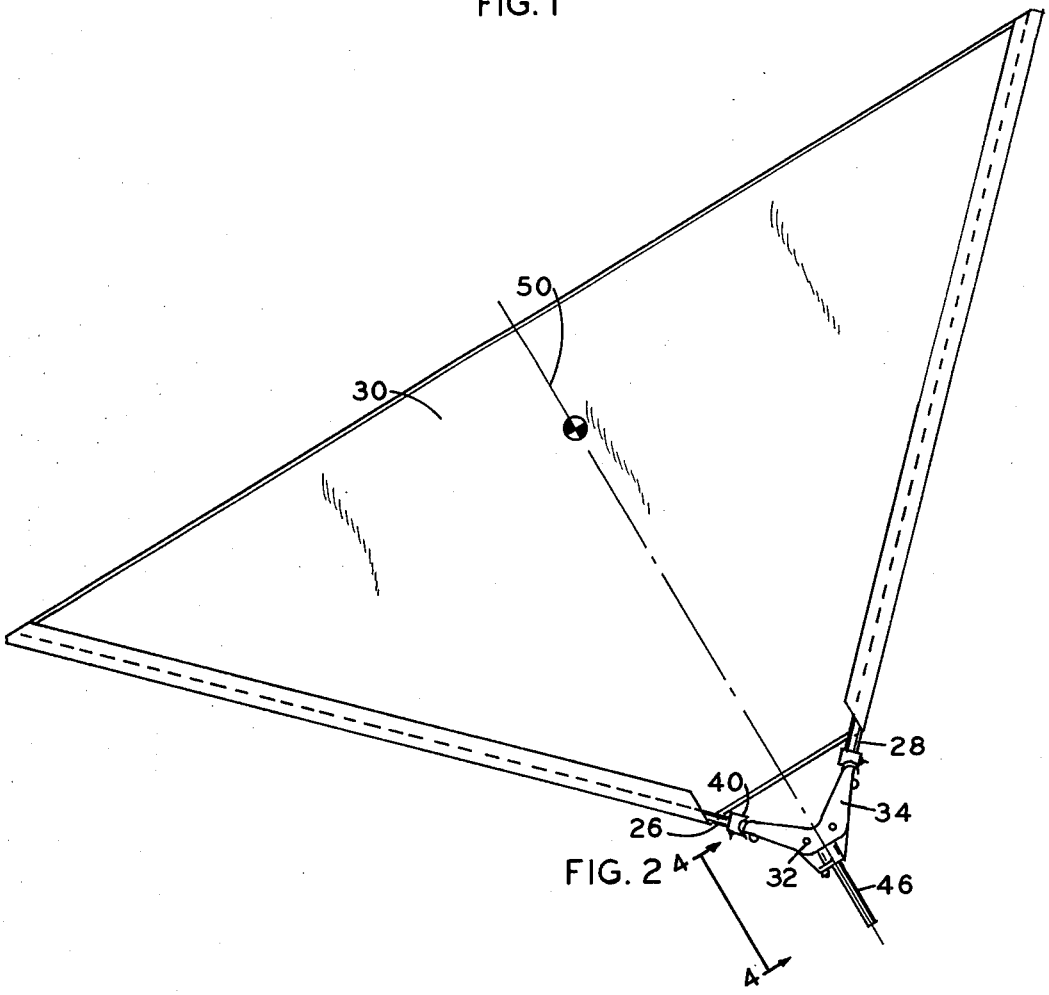
FIG. 2 is a side view of the sail assembly of this invention shown separate from the hull of the boat.

Referring particularly to the drawings, there is shown a sailboat 20 which includes a conventional hull 22 and a sail assembly 24. The sail assebmly 24 includes a pair of booms 26 and 28 with each boom basically comprising an elongated cylindrical tubular member. A fabric sail 30 is to be tightly stretched between the booms 26 and 28 when such are in a substantially right angle position with respect to each other. However, it is to be understood that it is not necessary to locate the booms 26 and 28 at a precisely right angle with respect to each other. This has merely been done as it seems to be a preferable design.

The boom 26 is pivotally attached by means of bolt 32 to a basically Y-shaped mounting member 34. The mounting member 34 includes an interior chamber 36. The boom 26 rests within one portion of the chamber 36 which is formed basically to the shape of a channel. The outer end 38 of the member 34 rests against the surface of the boom 26. A securing means in the form of a sleeve 40 is slidably mounted upon the boom 26. The sleeve 40 is to be slidable upon the boom 26 and is to partially cooperate over the end 38 of the mounting member 34. A wedging action between the boom 26 and the end 38 occurs which binds by means of slightly canting the sleeve 40 to bite into the exterior surface of the boom 26. As a result, a secure interconnecting between the boom 26 and the mounting member 34 occurs to hold the boom 26 in the extended position. Additional holes are provided within boom 26 in alignment with hole 32. These additional holes permit tightening of the sail 30 by extending the boom 26 to the other holes. The same is true with boom 28 and bolt 44.

Figures 3, 4, 5:
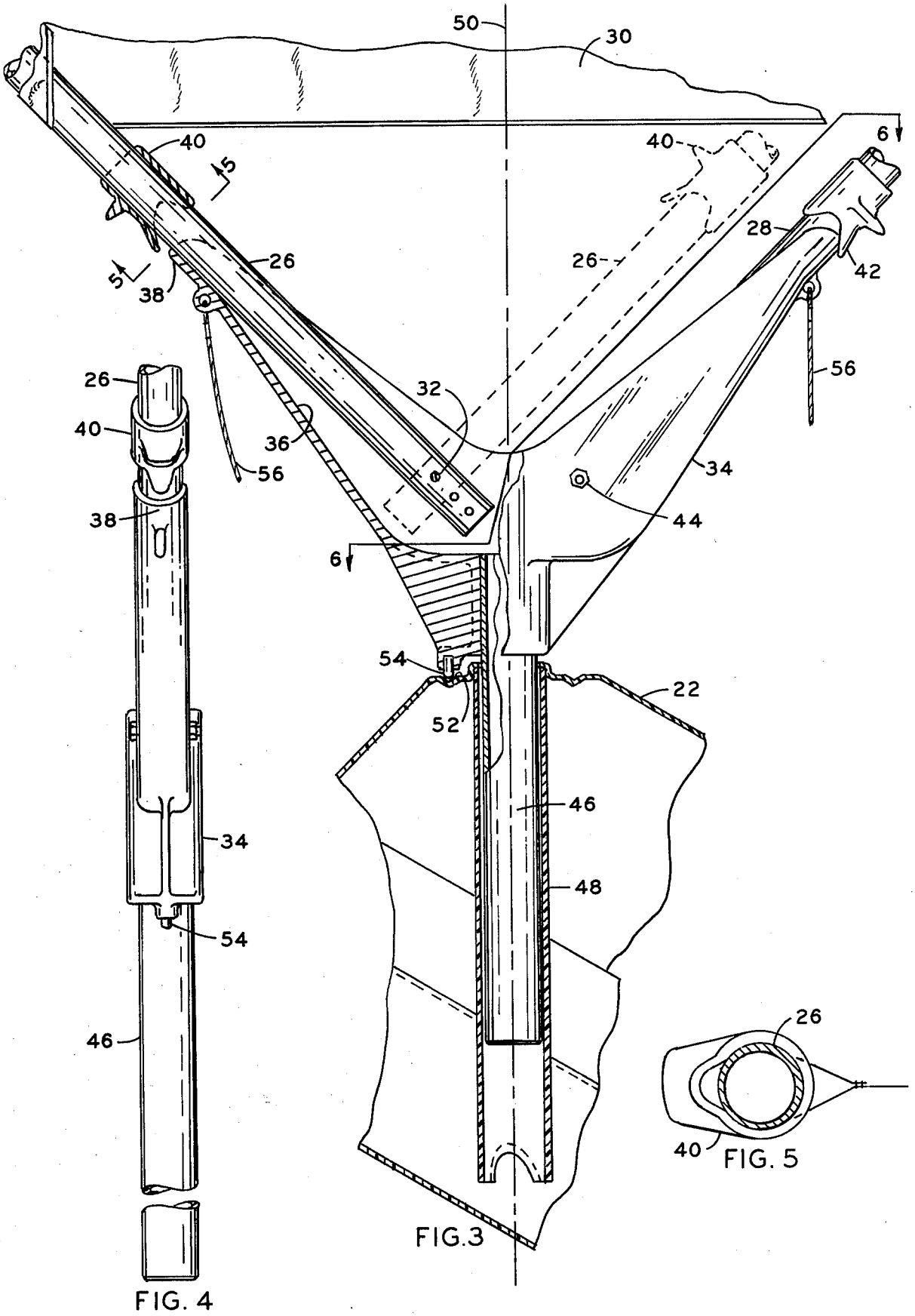
FIG. 3 is a partly in cross-sectional view of the mounting bracket section of the sail assembly of this invention.
FIG. 4 is a view of the mounting bracket section of the sail assembly taken along line 4—4 of FIG. 2.
FIG. 5 is a cross-sectional view taken along line 5—5 of FIG. 3.
Figure 6:
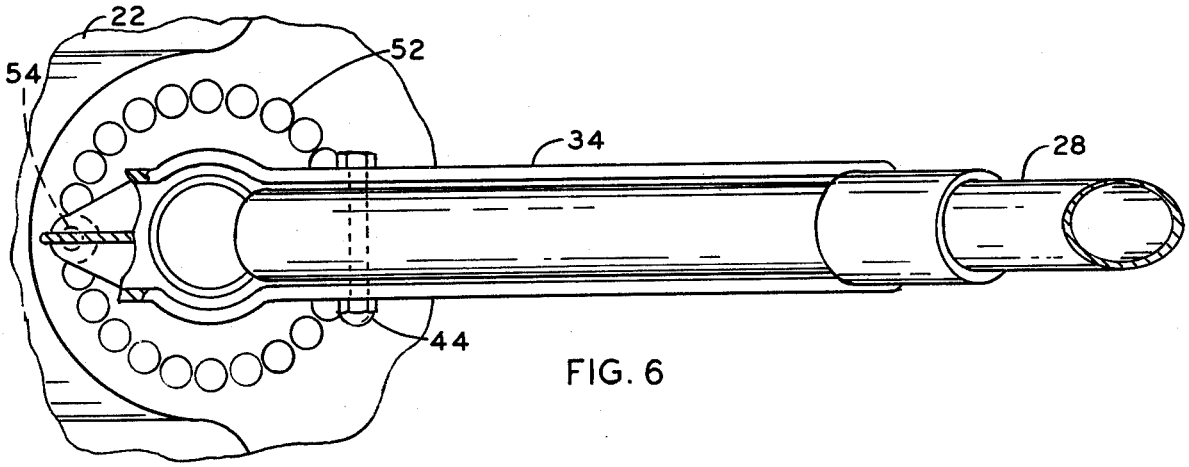
FIG. 6 is a partly in cross-sectional view taken along line 6—6 of FIG. 3.
Figure 7:
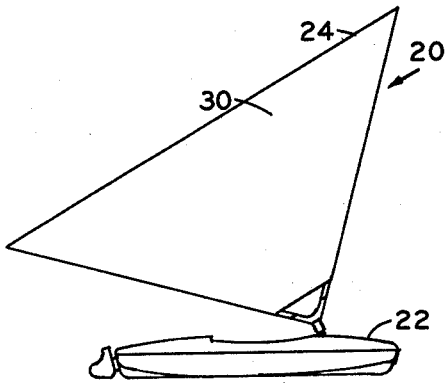
FIGS. 7 through 15 schematically depict the sail assembly in different positions with respect to the hull of the boat, such positions as would normally be encountered during sailing.
Figure 10:
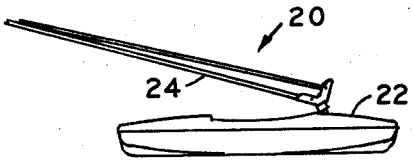

Upon disconnecting of the sleeve 40 from the end 38 of the mounting member 34, the boom 26 may be pivoted to the dotted line position shown in FIG. 3 of the drawings. This results in the boom 26 being located directly adjacent the boom 28 and assuming a position substantially as shown in FIG. 10 of the drawings. This is to be considered a collapsed position or storage position. Since a similar sleeve 42 is mounted upon the boom 28 and the boom 28 extends within a portion of the chamber 36 and the boom 28 being pivotally secured by a bolt 44 to the mounting member 34, the option also exists for the boom 28 to be pivoted directly adjacent the boom 26.

Fixedly mounted within the lower end of the mounting member 34 is a cylindrical shaped rod 46. The rod 46 is close fittingly mounted, but rotationally mounted, within tube 48. The tube 48 is integrally secured within the hull 22. As a result, the entire sail assembly 24 may be rotated with respect to the hull 22 about the axis of rotation 50.

Formed within the hull 22 directly adjacent and about the tube 48 are a plurality of recesses 52. It is to be noted that there are substantially 24 different recesses 52. However, the number of the recesses 52 may be readily varied.

Fixedly mounted within the lower end of the mounting member 34 is a protuberance 54. The protuberance 54 is capable of cooperating with any one of the recesses 52. Actually, during rotational movement of the sail assembly 24, the protuberance 54 will merely pass from one recess 52 into another recess 52. The cooperation between the protuberance 54 and the recesses 52 comprises a detent. This detent requires a small force to be applied to the sail assembly 24 in order to cause rotation of such with respect to the hull 22. Since the center of the wind force being subjected to the sail 30 is continuously at a point along the axis of rotation 50, the distribution of force across the sail 30 is equal. This means that there is no unequal application of torque and no matter what the wind force or direction, the sail assembly 24 will be held in its established position. However, the operator by manually pivoting of the sail assembly 24, changes the angular position of the sail assembly. The detent is desired to merely prevent freewheeling inertial rotation of the sail assembly.

In order to assist the operator in manual pivoting of the sail assembly, a lanyard 56 is attached on each side of the mounting member 34. This lanyard 56 is to be grasped in the hands of the operator as shown in FIG. 1 of the drawings, and the operator by merely exerting pulling movement on one side or the other side of the lanyard 56 causes rotation of the sail assembly 24.

Figure 8:
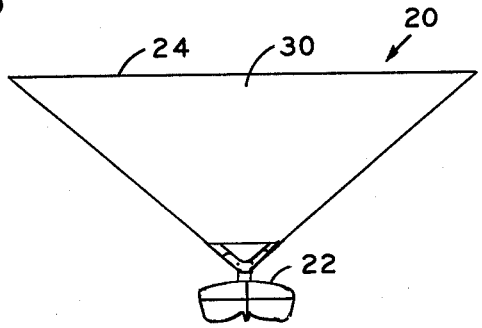
Figure 9:
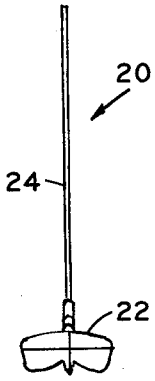
Figure 11:
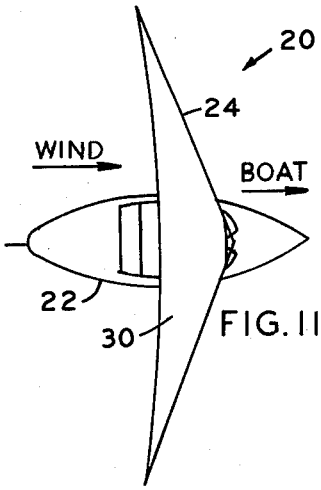
Figure 12:
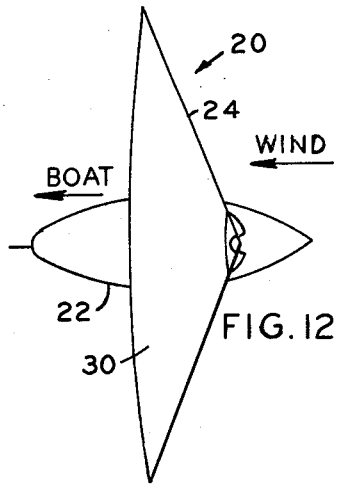
Figure 13:
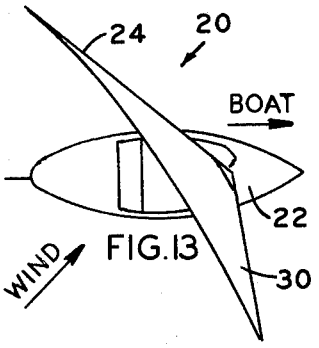
Figure 14:
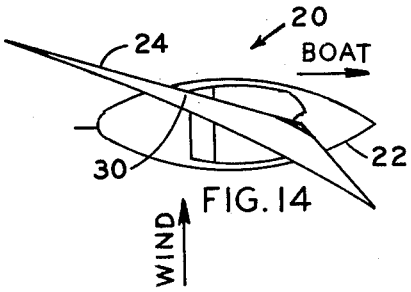
Figure 15:
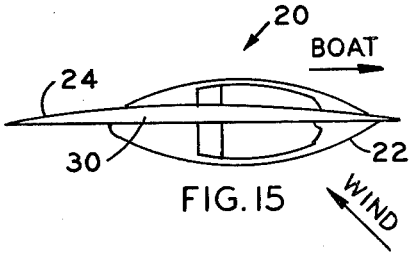

Referring particularly to FIGS. 7 through 15, there are depicted different positions of the sail assembly 24 with respect to the hull 22. FIG. 9 is basically a front end view of FIG. 7. FIG. 8 is a front view of either FIG. 11 or FIG. 12. The only difference between FIGS. 11 and 12 is that the direction of the wind is in the opposite direction within FIG. 12 from that of FIG. 11. FIG. 15 is a top view of the sail substantially in the position shown in FIG. 7.

Figure 16:
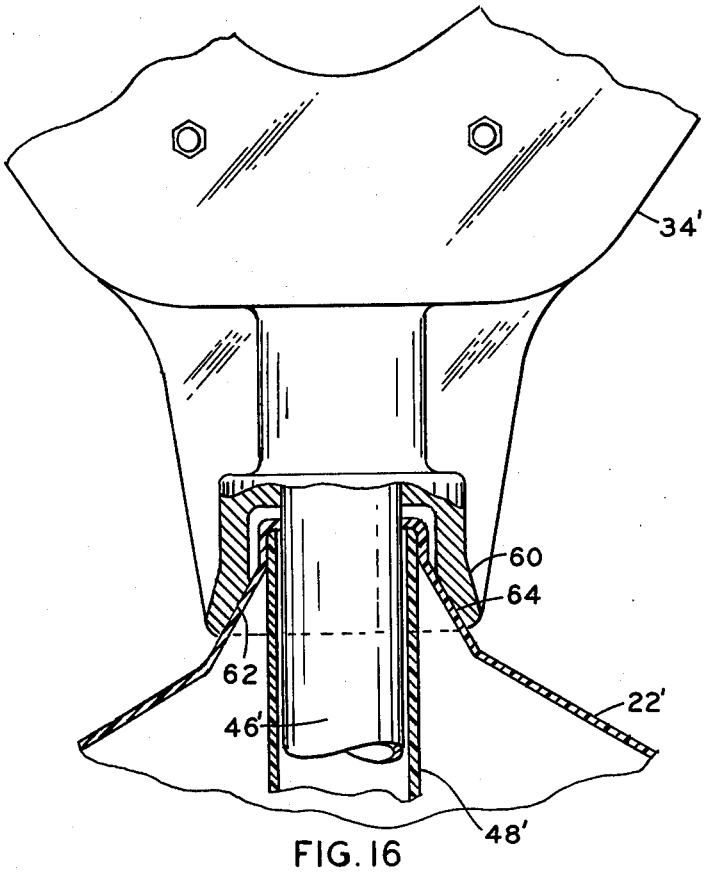
FIG. 16 is a view similar to FIG. 3 but of a second embodiment of mounting bracket of the sail assembly.

Referring particularly to FIG. 16, there is a second embodiment of attachment of the mounting member 34' to the hull 22' of a boat. This second embodiment of attachment employs a rod member 46' which is fixedly secured to the mounting member 34', this rod member 46' being rotationally mounted within a tubular member 48'. However, instead of the detent of the first embodiment, a frictional drag means is provided betwen the mounting member 34' and the hull 22'. This frictional drag is continuous and permits the sail to be positioned at any angle with respect to the hull, where, within the first embodiment, there are only 24 angular locations possible of the sail assembly with respect to the hull. The frictional drag takes the form of a sleeve 60 which has a tapered frusto-conical surface 62. The surface 62 rests flush against a conical surface 64 formed on the hull 22'.

Figure 17:
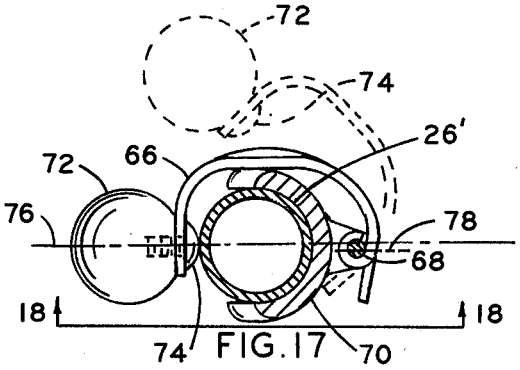
FIG. 17 is a view similar to FIG. 5 but showing a second embodiment of securing means which is to secure one of the booms to the mounting member.
Figure 18:
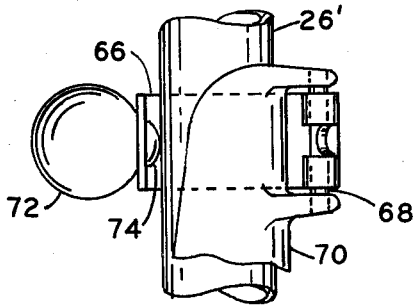
FIG. 18 is a view taken along line 18—18 of FIG. 17.

Referring particularly to FIGS. 17 and 18, a clamping structure is shown which is to be capable of being employed in lieu of the sleeve 40. This clamping structure takes the form of a pivotal member 66, which is pivotally secured by means of a pivot pin 68 to a bracket 70. The bracket 70 is fixedly mounted upon the rod 26' (or the rod 28). Attached to the outer end of the member 66 is a grasping handle 72 in the form of a sphere 72. A threaded fastener 74 (only the head of which is shown in solid lines in FIGS. 17 and 18) secures the sphere 72 to the member 66.

With the securing device of FIGS. 17 and 18 in the securing or operating position, a line 76 is shown interconnecting the center of the boom 26' and the point of contact of the head of the fastener 74. It is to be noted that the line 76 does not pass through the pivoting axis which extends through the center of the pin 68. A line 78 is drawn which does extend to the center of the pin 68 and it is noted that the line 78 is drawn parallel to the line 76. If a line were drawn interconnecting the point of contact of the head of the fastener 74 and the center of the pivot pin 68, it would be seen that this line would be displaced a small distance from the center of the boom 26'. This results in a slight over-the-center action which tends to maintain the device in the position shown in FIG. 17 unless the operator physically moves the device to the inoperative position. The inoperative position is depicted in phantom lines in FIG. 17.

What is claimed is:

1. A sailboat having a hull and a sail assembly, said sail assembly being connected to said hull by connecting means, the improvement comprising:

said sail assembly including a sail structure and a swivel means, said sail assembly including a mounting member, said swivel means cooperating with said connecting means to permit 360° movement of said sail structure relative to said hull, said swivel means moving about a single axis of rotation provided by an elongated rod rotationally mounted within an elongated tube in a close fitting manner, said elongated rod being attached to said mounting member, said hull having a longitudinal center axis which coincides with the direction of boat movement, said axis of rotation intersecting said longitudinal center axis at an acute angle;

said sail structure including a first elongated member and a second elongated member with a sail stretched therebetween when said sail is open, said axis of rotation when extended through the open said disects the sail into two substantially equal parts, said first and said second elongated members forming substantially a right angle when said sail is open, said first and said second elongated members being connected to said mounting member, at least one of said elongated members being movable in respect to said mounting member, whereby the one said elongated member may be moved directly adjacent the other said elongated member causing collapse of said sail, securing means connected to said one elongated member to secure the said one elongated member to said mounting member when said sail is open; and said mounting member including rotation retarding means, said rotation retarding means preventing freewheeling inertial movement of said rod in said tube, said rotation retarding means facilitating manual movement of said sail assembly to different angular positions in respect to said hull, said rotation retarding means including structure annularly located about said elongated rod.

2. The sailboat as defined in claim 1 wherein:

said rotation retarding means comprising a sleeve secured to said mounting member, said sleeve continuously frictionally engaging said hull.

3. A sailboat having a hull and a sail assembly, said sail assembly being connected to said hull by connecting means, the improvement comprising:

said sail ssembly including a sail structure and swivel means, said swivel means cooperating with said connecting means to permit 360° movement of said sail structure relative to said hull, said swivel means moving about a single axis of rotation, said hull having a longitudinal center axis which coincides with the direction of boat movement, said axis of rotation intersecting said longitudinal center axis at an acute angle;

said sail structure including a first elongated member and a second elongated member with a sail stretched therebetween when said sail is open, said axis of rotation when extended through the open sail disects the sail into two substantially equal parts, said first and said second elongated members forming substantially a right angle when said sail is open, said first and said second elongated members being connected to a mounting member, at least one of said elongated members being movable in respect to said mounting member, whereby the one said elongated member may be moved directly adjacent the other said elongated member causing collapse of said sail, securing means connected to said one elongated member to secure the said one elongated member to said mounting member when said sail is open;

said mounting member including a cylindrical rod, said cylindrical shaped rod establishing a close fitting relationship with a cylindrical shaped tube fixedly mounted within said hull;

said mounting member including rotation retarding means, said rotation retarding means preventing freewheeling inertial movement of said rod in said tube, said rotation retarding means facilitating manual movement of said sail assembly to different angular positions in respect to said hull;

said rotation retarding means comprising a detent, said detent comprising a protuberance attached to said mounting member, said protuberance to cooperate with one of several recesses formed within said hull.

4. A sailboat having a hull and a sail assembly, said sail assembly being connected to said hull by connecting means, the improvement comprising:

said sail assembly including a sail structure and swivel means, said swivel means cooperating with said connecting means to permit 360° movement of said sail structure relative to said hull, said swivel means moving about a single axis of rotation, said hull having a longitudinal center axis which coincides with the direction of boat movement, said axis of rotation intersecting said longitudinal center axis at an acute angle;

said sail structure including a first elongated member and a second elongated member with a sail stretched therebetween when said sail is open, said axis of rotation when extended through the open sail disects the sail into two substantially equal parts, said first and said second elongated members forming substantially a right angle when said sail is open, said first and said second elongated members being connected to a mounting member, at least one of said elongated members being movable in respect to said mounting member, whereby the one said elongated member may be moved directly adjacent the other said elongated member causing collapse of said sail, securing means connected to said one elongated member to secure the said one elongated member to said mounting member when said sail is open;

said securing means being longitudinally movable upon the said movable elongated member, said securing means taking the form of a sleeve which is capable of coming into tight contact with a portion of said mounting member thereby tightly securing said movable elongated member to said mounting member.

5. The sailboat as defined in claim 4 wherein:

said mounting member including a cylindrical rod, said cylindrical shaped rod establishing a close fitting relationship with a cylindrical shaped tube fixedly mounted within said hull.

6. The sailboat as defined in claim 5 wherein:

said mounting member including rotation retarding means, said rotation retarding means preventing freewheeling inertial movement of said rod in said tube, said rotation retarding means facilitating manual movement of said sail assembly to different angular positions in respect to said hull.

7. The sailboat as defined in claim 6 wherein:

said rotation retarding means comprising a detent, said detent comprising a protuberance attached to said mounting member, said protuberance to cooperate with one of several recesses formed within said hull.

8. The sailboat as defined in claim 6, wherein:

said rotation retarding means comprising a sleeve secured to said mounting member, said sleeve continuously frictionally engaging said hull.

9. A sailboat having a hull and a sail assembly, said sail assembly being connected to said hull by connecting means, the improvement comprising:

said sail assembly including a sail structure and swivel means, said swivel means cooperating with said connecting means to permit 360° movement of said sail structure relative to said hull, said swivel means moving about a single axis of rotation, said hull having a longitudinal center axis which coincides with the direction of boat movement, said axis of rotation intersecting said longitudinal center axis at an actue angle;

said sail structure including a first elongated member and a second elongated member with a sail stretched therebetween when said sail is open, said axis of rotation when extended through the open sail disects the sail into two substantially equal parts, said first and said second elongated members forming substantially a right angle when said sail is open, said first and said second elongated members being connected to a mounting member, at least one of said elongated members being movable in respect to said mounting member, whereby the one said elongated member may be moved directly adjacent the other said elongated member causing collapse of said sail, securing means connected to said one elongated member to secure the said one elongated member to said mounting member when said sail is open;

said securing means comprising an over-the-center toggle device that when in the operative position securely binds said movable elongated member to said mounting member.

10. The sailboat as defined in claim 9 wherein:

said mounting member including a cylindrical rod, said cylindrical shaped rod establishing a close fitting relationship with a cylindrical shaped tube fixedly mounted within said hull.

11. The sailboat as defined in claim 10 wherein:

said mounting member including rotation retarding means, said rotation retarding means preventing freewheeling inertial movement of said rod in said tube, said rotation retarding means facilitating manual movement of said sail assembly to different angular positions in respect to said hull.

12. The sailboat as defined in claim 11 wherein:

said rotation retarding means comprising a detent, said detent comprising a protuberance attached to said mounting member, said protuberance to cooperate with one of several recesses formed within said hull.

13. The sailboat as defined in claim 11 wherein:

said rotation retarding means comprising a sleeve secured to said mounting member, said sleeve continuously frictionally engaging said hull.

* * * * *